US007044523B1

(12) United States Patent
Roberts et al.

(10) Patent No.: US 7,044,523 B1
(45) Date of Patent: May 16, 2006

(54) BACK SAVER STRAP

(76) Inventors: Daniel J. Roberts, 101 Westwood Dr., West Springfield, MA (US) 01089; George L. Vershon, Jr., 36 Hampden La., Agawam, MA (US) 01001; Mark A. Koziol, 847 St. James Ave., Springfield, MA (US) 01104

( * ) Notice: Subject to any disclaimer, the term of this patent is extended or adjusted under 35 U.S.C. 154(b) by 0 days.

(21) Appl. No.: 10/830,884

(22) Filed: Apr. 26, 2004

Related U.S. Application Data

(60) Provisional application No. 60/467,265, filed on May 5, 2003.

(51) Int. Cl.
*B65G 7/12* (2006.01)

(52) U.S. Cl. ..... 294/152; 294/165

(58) Field of Classification Search ..... 294/27.1, 294/31.2, 148, 149, 150, 152, 155, 157, 165
See application file for complete search history.

(56) References Cited

U.S. PATENT DOCUMENTS

| | | | | | |
|---|---|---|---|---|---|
| 618,333 | A | * | 1/1899 | Colteryahn | 294/157 |
| 935,364 | A | * | 9/1909 | Gillespie | 217/125 |
| 2,508,795 | A | * | 5/1950 | Nielsen | 294/152 |
| 2,789,002 | A | * | 4/1957 | Nicholas | 294/33 |
| 3,964,126 | A | * | 6/1976 | Madsen | 294/31.2 |
| 4,127,223 | A | * | 11/1978 | Uchin | 294/150 |
| 5,096,080 | A | | 3/1992 | Penny | |
| 5,169,199 | A | * | 12/1992 | de Ruyter et al. | 294/149 |
| 6,257,473 | B1 | | 7/2001 | Ringelstetter | |
| 6,394,041 | B1 | | 5/2002 | Katz | |

* cited by examiner

*Primary Examiner*—Dean J. Kramer
(74) *Attorney, Agent, or Firm*—Deborah A. Basile

(57) ABSTRACT

Disclosed herein is a strap comprising a plurality of handle strips, wherein each handle strip forming the plurality comprises a handling element, e.g., a loop, whereby a user can grasp the handle strip; and an anchor strip, wherein the anchor strip secures the plurality of handle strips to a receptacle.

16 Claims, 2 Drawing Sheets

BACK SAVER STRAP

CROSS REFERENCE TO RELATED APPLICATIONS

This application claims the benefit of U.S. Provisional Application No. 60/467,265 filed on May 5, 2003.

BACKGROUND OF THE INVENTION

1. Field of the Invention

The invention relates generally to a device to be used with a barrel or other receptacle which improves the method of use and usefulness of the barrel or receptacle for household, commercial, or industrial refuse or debris.

2. Background of the Invention

Receptacles, which tend to be heavy and/or cumbersome, are difficult to maneuver. This oftentimes makes it difficult to move, or otherwise manipulate, the receptacle. For example, a common problem encountered with the use of receptacles, such as barrels used to contain household, commercial, and industrial refuse or debris, is that it is difficult to remove the refuse from the barrel and to reposition the barrel for normal use once the refuse is removed. For example, when emptying a trash barrel, oftentimes a user must turn the barrel upside down, and then reposition the barrel to an upright position once the refuse has been removed. This can be difficult, for example, where the barrel is heavy and/or cumbersome, and when the barrel is in an awkward position relative to a user. Grasping the barrel on its sides, or by its handles, oftentimes does not provide a user with sufficient support, causing the user the lose hold of the barrel. Additionally, grabbing onto and lifting traditional receptacles can cause a strain on the arms and back of a user. Accordingly, what is needed is a device that allows a user to gain a stronghold on a receptacle, whereby movement and manipulation of the receptacle causes less of a physical strain on a users back and arms.

BRIEF SUMMARY OF THE INVENTION

The above problems are alleviated by a strap comprising a plurality of handle strips, wherein each handle strip forming the plurality comprises a handling means, e.g., a loop, whereby a user can grasp the handle strip thereby facilitating the manipulation of a receptacle to which the handle strips are secured; and an anchor strip, wherein the anchor strip secures the plurality of handle strips to a receptacle.

DETAILED DESCRIPTION OF THE PREFERRED EMBODIMENT

Figure 1:
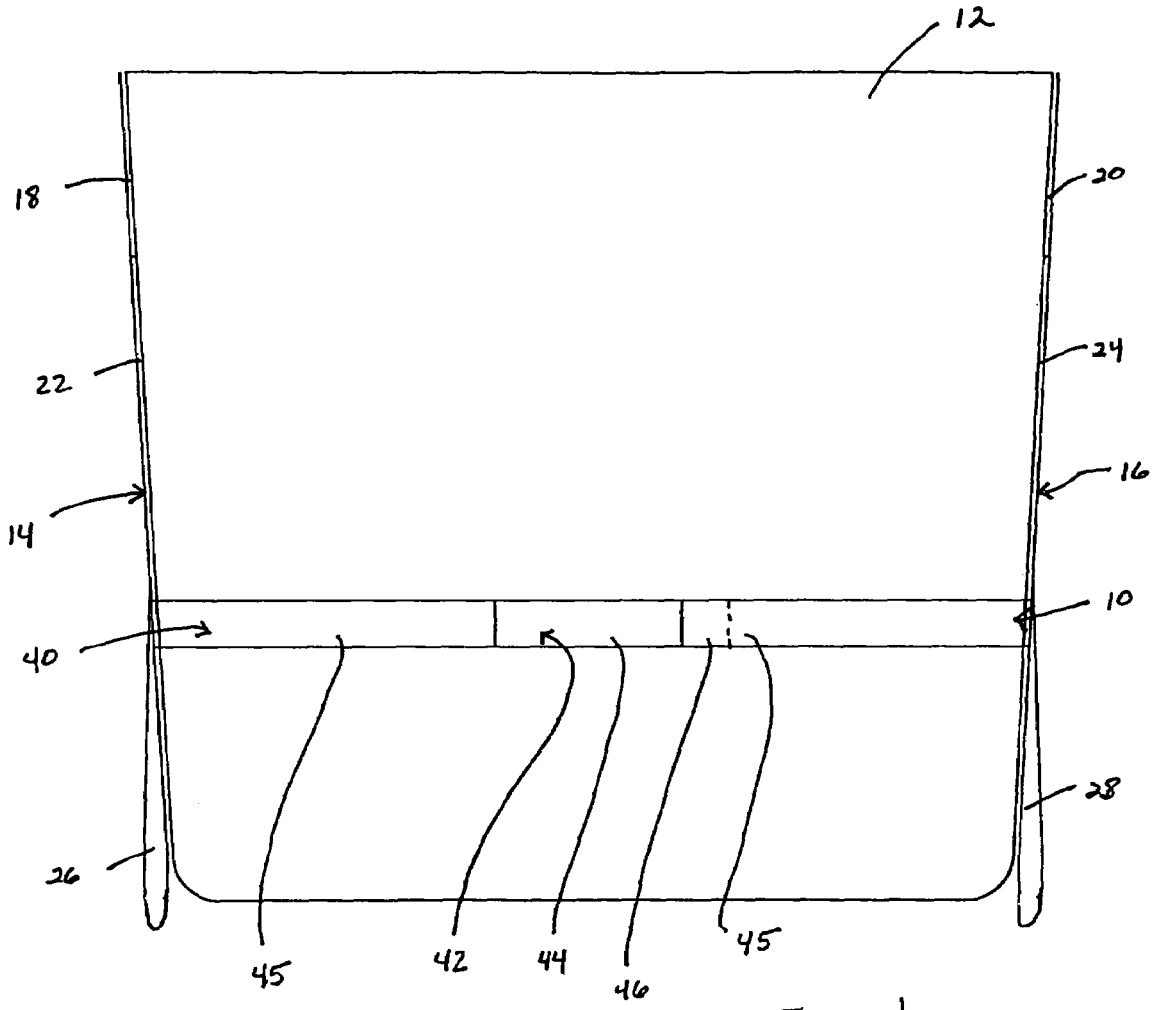
FIG. 1 is a schematic depicting an exemplary strap attached to an exemplary receptacle.

Disclosed herein is a strap preferably utilized in association with a receptacle, such as a barrel. The strap is manufactured to fit securely and snuggly on and around the receptacle. When installed on the receptacle, the strap creates a handling means which can be used to move, pull, or push the receptacle in the course of use of the receptacle either in filling, emptying, stacking, or otherwise moving or manipulating the receptacle. The strap facilitates the handling of receptacles that are otherwise heavy or cumbersome. The strap is also particularly helpful in the handling of trash barrels when removing refuse from the trash barrel, wherein such barrels are used in a household, commercial, or industrial setting. The strap has been found to be particularly beneficial in handling trash receptacles having a holding capacity of up to about 35 gallons. The strap is simple to manufacture, simple to install, and simple to use. Additionally, it reduces the strain on a user's back and arms by providing access points and weight distribution.

In general, the strap comprises a plurality of handle strips and an anchor strip, wherein the anchor strip secures the plurality of handle strips to a receptacle. The handle strips provide a means whereby a user can readily grasp and manipulate the receptacle. At least a portion of each of the handle strips extends along the exterior of the receptacle such that a user can readily grasp any one of the handle strips forming the plurality. In an exemplary embodiment, each of the handle strips extends up to about 1 inch past the bottom of the receptacle. Although the plurality of handle strips may comprise a wide variety of materials, wherein the material is governed only by the need to confer sufficient strength to the handle strip such that a user can manipulate the receptacle, both when the receptacle is at or below its carrying capacity, preferred materials comprise vinyl, nylon, polyester, cotton, combinations comprising at least one of the foregoing, and the like.

The strap further comprises an anchor strip secured to an outer circumference of the receptacle, wherein the anchor strip serves to stabilize the plurality of handle strips to the receptacle such that a user can easily handle and direct the receptacle. Hence, the anchor strip should be dimensioned such that it can fit tightly around the exterior circumferential surface of the receptacle, and thereby hold a portion of the plurality of handle strips against the receptacle.

Although the anchor strip may comprise two terminal ends that are continuously joined to each other, in a preferred embodiment, the two terminal ends are discontinous and are joined to each other by a fastening element. Although the fastening element may vary widely, and may include, for example Velcro®, an adjustable buckle and corresponding fastener, a button and corresponding button insert, snaps, and the like, Velcro® is preferred. Also, in a preferred embodiment, the anchor strip is adjustable in length such that the anchor strip can be used on a variety of sized receptacles.

Additionally, the anchor strip may comprise a wide variety of materials, wherein the material is governed only by the need to confer sufficient strength to the anchor strip such that it can withstand the weight and force of the receptacle and its load. However, in a preferred embodiment, the material comprises vinyl, nylon, polyester, cotton, combinations comprising at least one of the foregoing, and the like.

Additionally, in an exemplary embodiment, the handle strips may each comprise a securing element whereby the handle strip may be further secured to the receptacle. The type of securing element used to secure each handle strip to the receptacle may vary widely. For example, the securing element may comprise Velcro®; adhesives, such as glue, tape, and the like; hooks; screws; pins; staples; and the like; wherein Velcro® is preferred. Accordingly, the plurality of handle strips may be permanently or transiently secured to the receptacle, wherein it is preferred that the plurality of handle strips be removable, such that a single strap can be used on multiple receptacles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, FIG. 1 depicts an exemplary strap 10 secured to a receptacle 12. Strap 10 comprises handle strips 14 and 16. Although FIG. 1 depicts two handle strips disposed on opposite sides of receptacle 12, it is contemplated herein that the strap may comprise any number of handle strips, wherein the handle strips are positioned to facilitate movement of the receptacle and to simultaneously reduce strain on a user's back and arms. Handle strips 14 and 16 each respectively comprises an attachment segment 18, 20, a connecting segment 22, 24, and a handling element, wherein the handling elements are depicted as loops 26, 28.

Attachment segments 18, 20, which comprise a securing element, serve to adhere handle strips 14, 16 to receptacle 12. FIG. 1 depicts attachment segments 18, 20 as comprising Velcro®, wherein receptacle 12 comprises a hook/loop portion corresponding to attachment segments 18, 20 Velcro® piece.

Figure 2:
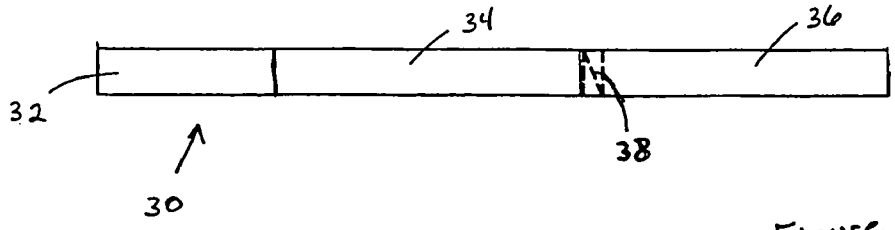
FIG. 2 is a schematic depicting a top view of an exemplary handle strip.
Figure 3:
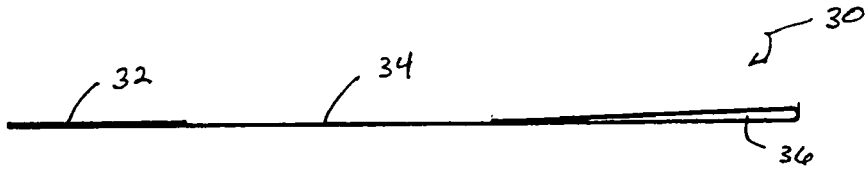
FIG. 3 is a schematic depicting a side view of the exemplary handle strip depicted in FIG. 2.

FIGS. 2 and 3 depict an exemplary handle snip 30 suitable for use in strap 10 as shown in FIG. 1. Referring to FIGS. 2 and 3, handle strip 30 comprises an attachment segment 32, a connecting segment 34, and a loop segment 36. Loop segment 36 comprises stitching 38 whereby a terminal end of connecting segment 34 is stitched onto the beginning end of loop segment 36 to form a loop. The loop is preferably wide enough to allow a user's hand to be inserted through the loop.

As previously stated, the length of the handle strip may vary widely. However, in a preferred embodiment, the ratio of attachment segment 32: connecting segment 34: handling element, e.g., loop segment 36 is about 0.60:1.00:1.00. In a particularly preferred embodiment, the length of handle strip 30 comprises a length of about 18 inches, wherein attachment segment 32 may comprises a length of about 4 inches, and loop segment 36 may comprises a length of about 7 inches.

Figure 4:
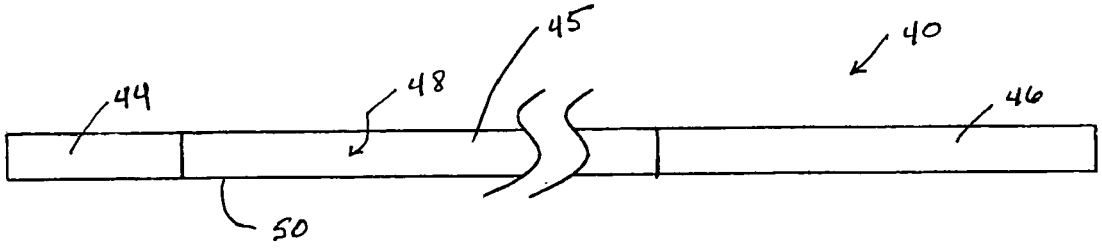
FIG. 4 is a schematic depicting a top view of an exemplary anchor strip.
Figure 5:
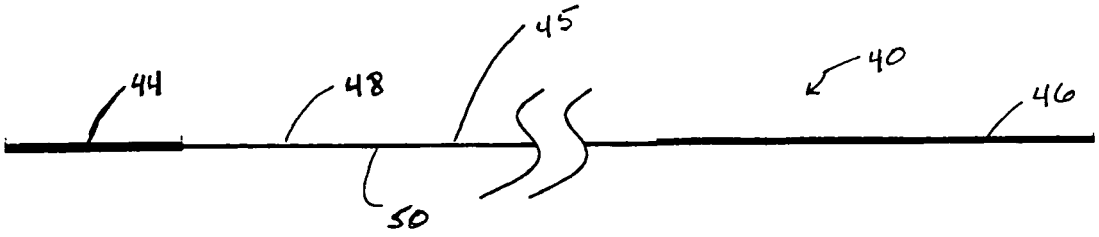
FIG. 5 is a schematic depicting a side view of the exemplary anchor strip depicted in FIG. 4.

Again referring to FIG. 1, strap 10 further comprises an anchor strip 40, wherein anchor strip 40 is positioned through each of loop segments 26 and 28. Referring to FIGS. 1, 4, and 5, anchor strip 40 is secured to receptacle 12 by means of a fastening element 42, such as Velcro®. Fastening element 42 comprises an attachment site 44 on a proximal end of anchor strip 40 and a complementary attachment site 46 on the opposite distal end of anchor strip 40. Attachment site 44 may comprise Velcro®, wherein the Velcro® is disposed on both a top side 48 and a bottom side 50 of attachment site 44. Complementary attachment site 46 comprises a complementary Velcro® portion, which secures either top side 48 or bottom side 50 to complementary attachment site 46. Attachment site 44 is joined to complementary attachment site 46 by a connector region 45. Connector region 45 may comprise an elastic material whereby the length of anchor strip 40 may be adjusted so long as the elastic material can sufficiently hold anchor strip 40 in place such that anchor strip stabilizes handling strips 14, 16 onto receptacle 12.

The length of anchor strip 40, and its associated parts, may vary widely. However, in a preferred embodiment, the ratio of attachment site 44: connector region 45: complementary attachment site 46 is about 0.40:5.00:1.00. In a particularly preferred embodiment, the length of anchor strip 40 comprises a length of about 64 inches, wherein attachment site 44 comprises a length of about 4 inches, and complimentary attachment site 46 comprises a length of about 10 inches. It is preferred that complimentary attachment site 46 be longer than that of attachment site 44 so that the circumference of anchor strip 40 can be adjusted.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In its preferred method of use, the strap may be secured onto a receptacle to facilitate movement and handling of the receptacle. Additionally, the strap is quickly and easily assembled onto the receptacle. For example, the plurality of handle strips may be secured onto the receptacle by means of the securing elements. The anchor strip may be positioned through the loops of each of the plurality of handle strips such that the anchor strip covers a portion of the circumference of the receptacle. The length and/or the circumference of the anchor strip is preferably adjusted until the anchor strip fits tightly around the receptacle such that the mobility of the anchor strip is restricted. If the anchor strip does not comprise an adjustor element, i.e., a means for adjusting the length and/or circumference of the anchor strip, the anchor strip preferably comprises a length sufficient to fit around a circumference of the receptacle such that movement of the anchor strip is restricted, thereby ensuring that the handling strips are secured to the receptacle. Where the attachment site and complimentary attachment sites of the anchor strip comprise Velcro®, the attachment site containing the Velcro® can be disposed anywhere along the length of the complimentary attachment site containing the corresponding Velcro® portion such that the anchor strip is firmly secured to and around the receptacle.

Once the strap is installed on the receptacle, a user can grasp at least one of the handling elements, e.g., loops, such that the receptacle can be easily moved and manipulated when, e.g., filling and discharging the contents of the receptacle. Additionally, the strap eases the strain on a user's back and arms by providing access points and weight distribution.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A strap comprising:

a plurality of handle strips, wherein each handle strip forming the plurality comprises:

a securing element attachable to a receptacle; and a handling element in communication with the securing element, whereby a user can grasp the handle strip, wherein the handling element comprises a loop; and an anchor strip, wherein the anchor strip secures the plurality of handle strips to the receptacle and wherein the anchor strip is disposed through at least one of the loops.

2. The strap of claim 1, wherein the anchor strip comprises a first terminal end and a second terminal end, wherein the first terminal end is temporarily secured to the second terminal end by a fastening element such that the anchor strip comprises a circumference.

3. The strap of claim 2, wherein the circumference is adjustable.

4. The strap of claim 2, wherein the fastening element comprises a hook and loop fastener.

5. An assembly comprising:

a receptacle comprising an exterior side having a circumference and defined by a top portion and a bottom portion;

a plurality of handle strips in association with the exterior side, wherein each of the handle strips comprises a first terminal end and a second terminal end, wherein the first terminal end comprises a securing element which secures the respective handle strip to the top portion of the receptacle, and the second terminal end comprises a handling element whereby a user can grasp the respective handle strip; and an anchor strip disposed around the circumference of the receptacle, wherein the anchor strip secures the plurality of handle strips to the receptacle.

6. The assembly of claim 5, wherein each of the handling elements comprises a loop.

7. The assembly of claim 6, wherein the anchor strip is disposed through the loops.

8. The assembly of claim 6, wherein the loops extend about 1 inch below the bottom of the receptacle.

9. The assembly of claim 5, wherein the securing element comprises a hook and loop element.

10. The assembly of claim 5, wherein the anchor strip comprises a first terminal end and a second terminal end, wherein, the first terminal end and the second terminal end are joined together by means of a fastening element such that the anchor strip comprises a circumference.

11. The assembly of claim 10, wherein the circumference of the anchor strip is adjustable.

12. The assembly of claim 10, wherein the fastening element comprises a hook and loop element.

13. An assembly comprising:

a receptacle comprising an exterior side and a circumference and defined by a top portion and a bottom portion;

a plurality of handle strips in association with the exterior side, wherein each of the handle strips comprising the plurality comprises a first terminal end and a second terminal end, wherein the first terminal end is secured to the top portion of the receptacle by a securing element, and wherein the second terminal end comprises a loop; and an anchor strip disposed through the loops of the handle strips, wherein the anchor strip comprises a third terminal end and a fourth terminal end, wherein the third and fourth terminal ends are secured to each other by a fastening element such that the anchor strip is disposed securely around the circumference of the receptacle.

14. The assembly of claim 13, wherein the securing element comprises a hook and loop element.

15. The assembly of claim 13, wherein the fastening element comprises a hook and loop element.

16. The assembly of claim 13, wherein the receptacle comprises a trash barrel.

* * * * *